United States Patent [19]

Kakumoto et al.

[11] Patent Number: 4,509,259

[45] Date of Patent: Apr. 9, 1985

[54] ELECTRIC SHAVER

[75] Inventors: Hiromi Kakumoto; Shinji Ihara; Yoji Iguchi; Makoto Miyata, all of Shiga, Japan

[73] Assignee: Matsushita Electric Works, Ltd., Osaka, Japan

[21] Appl. No.: 559,807

[22] Filed: Dec. 9, 1983

Related U.S. Application Data

[63] Continuation of Ser. No. 384,888, Jun. 4, 1982, Pat. No. 4,426,776.

[30] Foreign Application Priority Data

Jun. 15, 1981 [JP] Japan ..... 56-92734

[51] Int. Cl.[3] ..... B26B 19/10

[52] U.S. Cl. ..... 30/34.1; 30/43.9

[58] Field of Search ..... 30/43.9, 43.92, 44, 30/34.1, 41, 41.5

[56] References Cited

U.S. PATENT DOCUMENTS

| | | | |
|---|---|---|---|
| 2,601,720 | 7/1952 | Carissimi | 30/43 |
| 3,213,301 | 10/1965 | Jepson | 30/43.9 X |
| 3,412,463 | 11/1968 | Rundzaitis | 30/43.9 X |
| 3,772,779 | 11/1973 | Douglass et al. | 30/45 |
| 3,783,508 | 1/1974 | Brown | 30/34.1 X |
| 3,793,723 | 2/1974 | Kuris et al. | 30/45 |
| 4,426,776 | 1/1984 | Kakumoto | 30/34.1 |

FOREIGN PATENT DOCUMENTS 2137378 2/1974 Fed. Rep. of Germany .

*Primary Examiner*—Jimmy C. Peters

*Attorney, Agent, or Firm*—Stevens, Davis, Miller & Mosher

[57] ABSTRACT

An electric shaver with a trimmer is disclosed in which a single flexible seal is used to protect the motor and electric parts from water and other material entering through the perforated comb or the trimmer.

8 Claims, 12 Drawing Figures

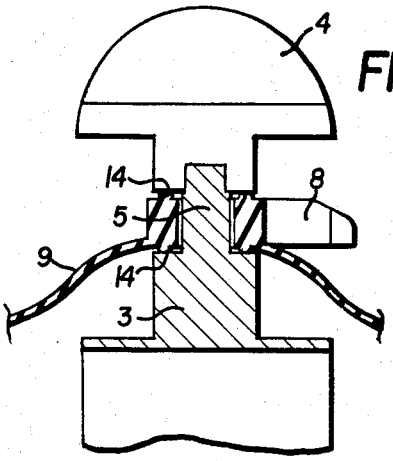
FIG. 5
FIG. 6
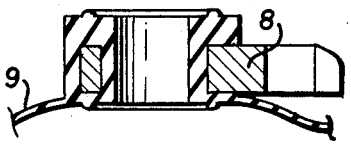
FIG. 7
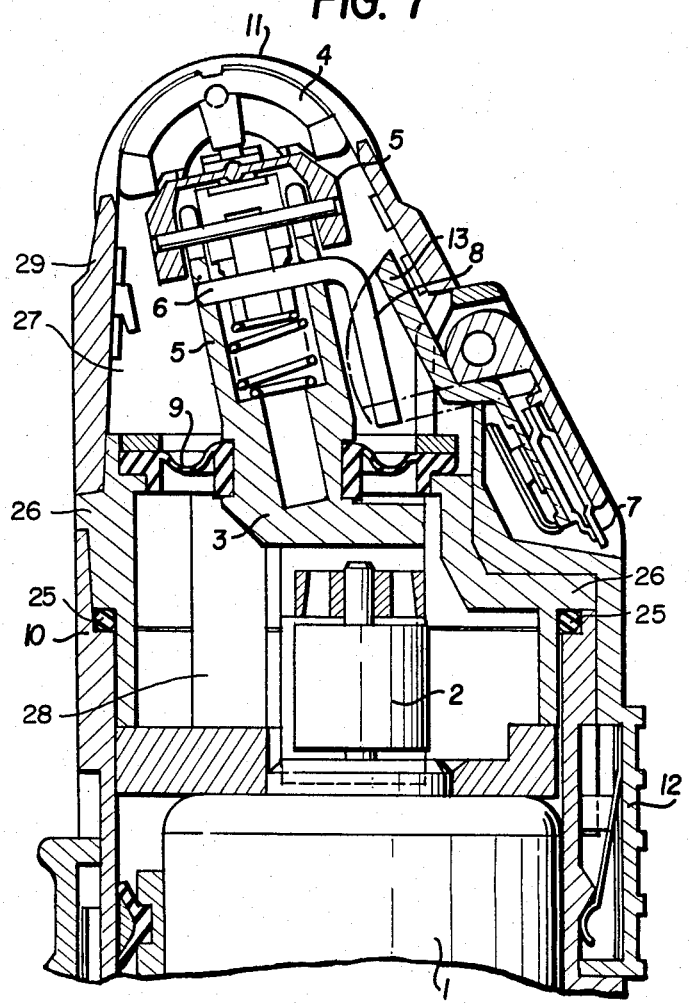

ELECTRIC SHAVER

This is a continuation of application Ser. No. 384,888 filed June 4, 1982 now U.S. Pat. No. 4,426,776.

BACKGROUND OF THE INVENTION

This invention relates to electric dry shavers having a trimmer. Such electric shavers are known in the art and have several advantages over safety razors, which are used with soap and water applied to the user's skin and thus are often known as wet shavers. However, electric shavers are inferior to wet razors in that they leave the user with a less refreshing feeling after shaving and in that they require cleaning to remove dust, whisker fragments and the like. Thus, electric shavers are sometimes washed in water to remove dust, whisker fragments and the like or used while bathing with soap and water. This can have a deleterious effect on a conventional electric shaver since, although its motor and electrical parts are protected from water entering through the perforated shaving comb, they are not protected from water entering through the trimmer. Thus, water may reach the motor and electrical parts in such conventional electric shavers causing a short circuit or malfunction of the motor or other electrical parts or otherwise resulting in damage and decreasing the useful life of the shaver. Also, whisker fragments and the like may also reach the motor or electric parts through the trimmer and also cause damage.

SUMMARY OF THE INVENTION

It is an object of the claimed invention to provide an electric shaver with a trimmer having a sealing means which protects the motor and electrical parts from water, dust, whisker fragments and the like which enter the electric shaver through its perforated comb and its trimmer. It is a further object of the claimed invention to provide such an electric shaver which has few parts, is less expensive and less complicated to produce, and is more reliable than conventional electric shavers with trimmers. These and other objects are attained in the claimed invention by an electric shaver having a novel sealing means which employs a single seal to seal its motor and electrical parts from water, dust, whisker fragments and the like entering from both its perforated comb and its trimmer.

BRIEF DESCRIPTION OF THE DRAWINGS

FIG. 5 is a semi-schematic detail, in cross-section, of the sealing means of a fourth embodiment of the electric shaver of the claimed invention;

FIG. 6 is a semi-schematic detail, in cross-section, of the sealing means of a fifth embodiment of the electric shaver of the claimed invention;

FIG. 7 is a partial side view, in cross-section, of a sixth embodiment of the electric shaver of the claimed invention;

DETAILED DESCRIPTION OF THE INVENTION

Figure 1:
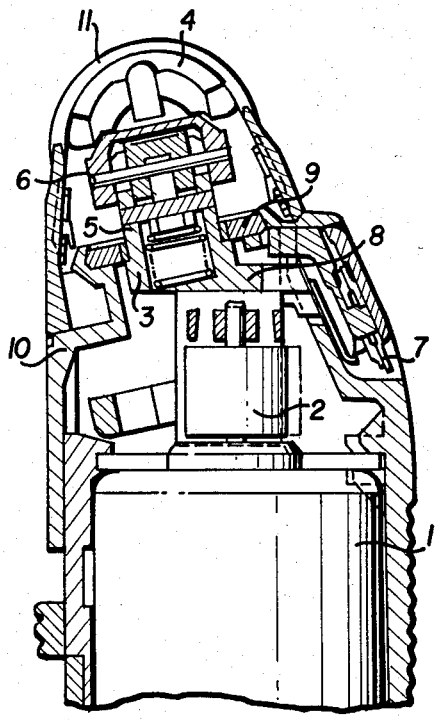
FIG. 1 is a partial side view, in cross-section, of a conventional electric shaver.

Referring now to FIG. 1, this shows a conventional electric shaver with a trimmer. In this conventional electric shaver, a set of parallel cutting blades 4 is mounted on a cutter blade platform which is driven in reciprocating motion beneath perforated comb 11. The reciprocating motion is perpendicular to the flat of blades 4, i.e., perpendicular to the plane of FIG. 1. The driving force for this reciprocating motion is provided by motor 1 through an eccentric cam 2 which is attached to the rotating shaft of motor 1. The resultant reciprocating motion generated by eccentric cam 2 is transmitted to drive element 3 by reciprocation conversion means well known to the art. Cutting blades 4 are detachably connected to drive element 3 by detachable mounting their cutter blade platform to the upper portion 5 of drive element 3 by a connecting pin. Motor housing casing 10 surrounds motor 1 and eccentric cam 2 as well as the lower portion of drive element 3. A dustproof and waterproof sealing plate 9 is disposed between drive element 3 and casing 10 and has a central opening through which drive element 3 projects. Sealing plate 9 acts to seal motor 1, eccentric cam 2 and the lower portion of drive element 3 from perforated comb 11, cutting blades 4 and the upper portion 5 of drive element 3. The electric shaver is provided with a trimmer 7 which may be rotated upward and outward for use. When trimmer 7 is so rotated, a trimmer drive stem extending from the end of trimmer 7 opposite to that of the trimming blades engages a trimmer drive lever 8 which projects from the lower portion of drive element 3. The trimmer drive lever 8 shares in the reciprocating motion of drive element 3 when the electric shaver is in operation. Thus when trimmer drive lever 8 and the trimmer drive stem engage, the reciprocating motion of trimmer drive lever 8 is transmitted to trimmer 7 to drive the trimming blades thereof.

As mentioned, such conventional electric shavers have several advantages over safety razors, which are used with soap and water applied to the user's skin and thus are often known as wet razors. However, such electric shavers are inferior to wet razors in that they leave the user with a less refreshing feeling after shaving and in that they require cleaning to remove dust, whisker fragments and the like. Thus, electric shavers are sometimes washed in water to remove whisker fragments or used while bathing with soap and water. This can have a deleterious effect on the electric shaver since, although its motor 1 and electrical parts are protected from water entering through perforated shaving comb 11 by sealing plate 9, they are not protected from water entering through trimmer 7 which is located beneath sealing plate 9. Thus, water may reach motor 1 and electrical parts beneath sealing plate 9 causing a short circuit or malfunction of motor 1 or these electrical parts or otherwise resulting in damage and decreasing the useful life of the shaver. Also, whisker fragments, dust and the like may also reach motor 1 or electric parts through trimmer 7 and cause damage.

Figure 2:
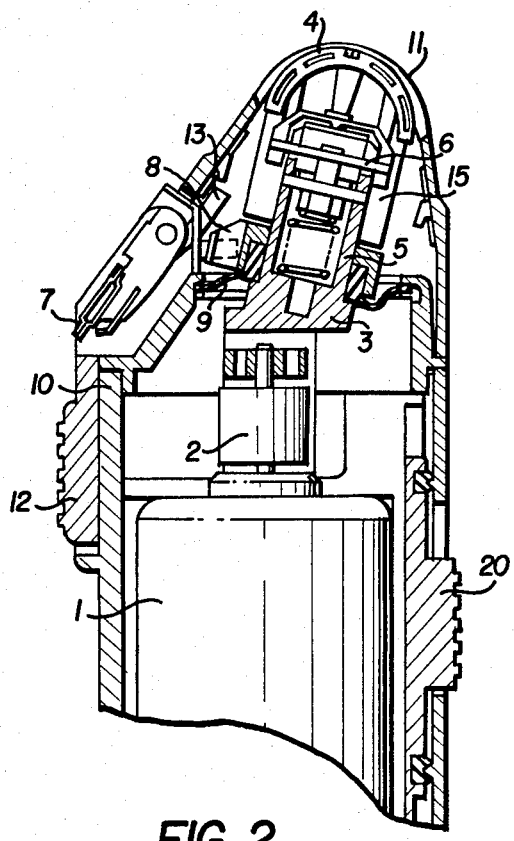
FIG. 2 is a partial side view, in cross-section, of a first embodiment of the electric shaver of the claimed invention.

FIG. 2 shows a first embodiment of the electric shaver of the claimed invention. In this embodiment, a set of parallel cutting blades 4 is mounted on a cutter blade platform which is driven in reciprocating motion beneath a perforated comb or outer blade 11. The reciprocating motion is perpendicular to the flat of blades 4, i.e., perpendicular to the plane of FIG. 2. The driving force for this reciprocating motion is provided by motor 1 through an eccentric cam 2 which is attached to the rotating shaft of motor 1. The resultant reciprocating motion generated by eccentric cam 2 is transmitted to drive element 2 by reciprocation conversion means well known to the art. Cutting blades 4 are detachably connected to drive element 3 by detachably mounting their cutter blade platform at the upper drive rod portion 5 of drive element 3 by connecting pin 6. Casing 10 defines a drive unit chamber 28 and surrounds motor 1 and eccentric cam 2. An outer blade frame 29 is mounted on the shaving head end of casing 10 and a shaving head enclosure (which includes perforated comb 11) is mounted on the outer blade frame 29 to define an inner blade chamber 27 (see FIG. 7). A trimmer 7 is mounted on a trimmer mounting base which is disposed between the support piece and the shavig head enclosure. Trimming blades are located at one end of trimmer 7 and may be rotated upward and outward for use by rotation of the trimmer 7 about a pivot at the other end of trimmer 7 which is fixed to the trimmer mounting base. Trimmer handle 12 is slidably mounted on casing 10, and engages trimmer 7 between its pivot and its trimmer blade end. Pivoting of trimmer 7 may be accomplished by moving trimmer handle 12 upward. Trimmer 7 is provided with a trimmer drive stem 13 extending from its pivot end. When trimmer 7 is rotated upward and outward by trimmer handle 12, trimmer drive stem 13 engages trimmer drive lever 8 which extends from a drive lever ring which is mounted around the upper portion 5 of drive element 3. The drive lever ring shares in the reciprocating motion of drive element 3. When trimmer drive stem 13 and trimmer drive lever 8 are engaged, the trimmer blades will also share in the reciprocating motion of drive element 3. A flexible sealing plate 9 is disposed below the drive lever ring between the mounting piece and drive element 3 and has a central opening through which drive element 3 projects. Sealing plate 9 has an inner bead portion around its central opening which engages drive element 3 and shares in its reciprocating motion. The inner bead of plate 9 also engages the lower portion of the driver lever ring. The drive lever ring may have a skirt extending downwardly from its periphery within which the inner bead of plate 9 may be engaged. Sealing plate 9 also has an outer bead along its outer edge which engages outer blade frame 29 mounted on casing 10. With its inner and outer beads so engaged, sealing plate 9 will seal motor 1 and eccentric cam 2 from dust, whisker fragments, water, soap and the like which enter through perforated comb 11 or trimmer 7. Furthermore, providing a single sealing plate 9 reduces the number of parts which would otherwise be required to effect such sealing and reduces manufacturing costs.

Figure 3:
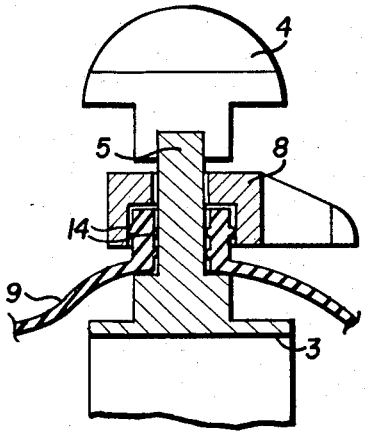
FIG. 3 is a semi-schematic detail, in cross-section, of the sealing means of a second embodiment of the electric shaver of the claimed invention.
Figure 4:
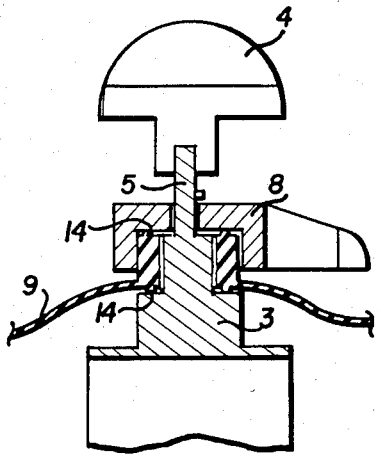
FIG. 4 is a semi-schematic detail, in cross-section, of the sealing means of a third embodiment of the electric shaver of the claimed invention.

As shown in FIG. 3, to further improve the sealing effect of sealing plate 9, semi-circular sealing rings 14 of the O-ring type may be disposed around the inner bead of plate 9 so as to lie between the inner bead of plate 9 and the inner wall of the skirt of the drive lever ring. Sealing rings 14 may also be disposed around the adjacent upper portion 5 of drive element 3 so as to lie between the inner bead of plate 9 and drive element 3. Alternatively these sealing rings 14 may be disposed on the upper and lower surfaces of the inner bead of plate 9 as shown in FIG. 4. These rings 14 may also be integral with sealing plate 9. In addition, an annular metal piece may be inserted in the inner annular bead of sealing plate 9, to further improve the sealing effect thereof.

As shown in FIG. 5, the inner bead of sealing plate 9 may be integral with the drive lever ring and trimmer drive lever 8, further reducing the number of parts and the manufacturing cost and increasing the sealing effect.

As shown in FIG. 6, the trimmer drive lever 8 may be integral with the annular metal insert further reducing the number of parts and cost and increasing the sealing effect.

As shown in FIG. 7, the connection pin 6 provided at the upper portion drive rod 5 of drive element 3 may be extended and bent at one end, the extended bent end forming a trimmer drive lever 8. The trimmer drive lever 8 so formed is thus distinct from drive element 3 and eliminates the necessity of extending a trimmer drive lever from a drive lever ring or from sealing plate 9. The other end of connecting pin 6 may be inserted in an insertion bore in drive element 3, the insertion bore being formed as an elongate slot or bore of the same cross-section as the unbent portion of connecting pin 6 so that connecting pin 6 is effectively locked in the insertion bore. Sealing plate 9 here is mounted prior to insertion of connecting pin 6 in drive element 3 and the connecting pin 6 is press fitted into drive element 3, thereby making it possible to readily mount sealing plate 9 without fear of damage, thus preventing the deterioration of its sealing effect. The inner bead of plate 9 is fitted into a groove around the lower portion of drive element 3.

Figure 8:
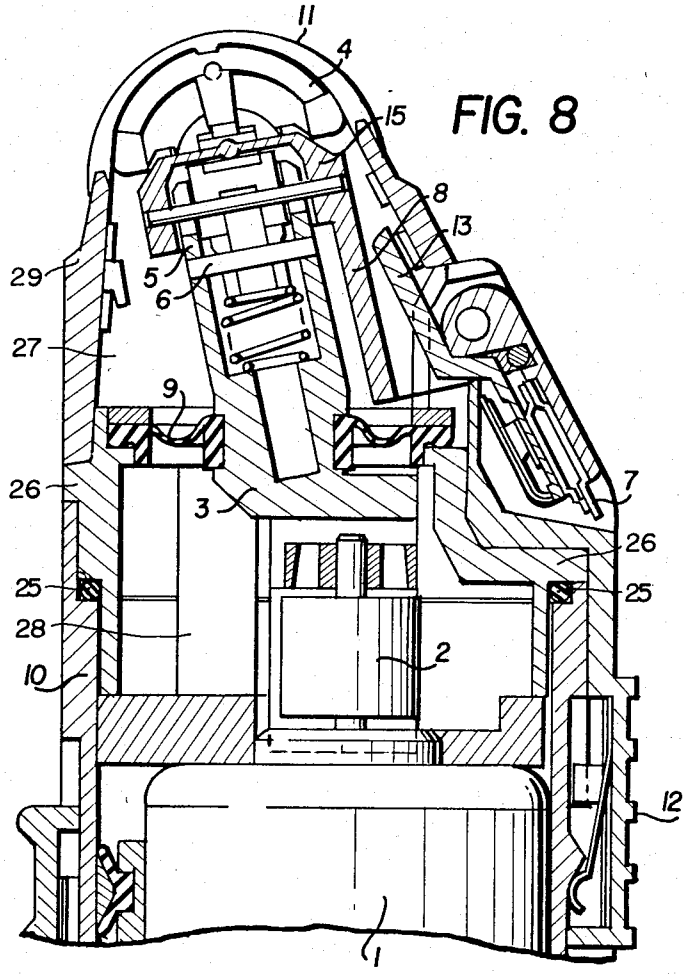
FIG. 8 is a partial side view, in cross-section, of a seventh embodiment of the electric shaver of the claimed invention.

In FIG. 8, the trimmer drive lever 8 is an integral downward extension of the central portion of cutter blade platform 15 (i.e. that portion which is directly above drive element 3). The trimmer drive lever 8 so formed is thus distinct from drive element 3 and eliminates the necessity of extending a trimmer drive lever from a drive lever ring or from sealing plate 9. As in the embodiment of FIG. 8, the inner bead of sealing plate 9 is mounted in a groove around the lower portion of drive element 3, permitting the opening in sealing plate 9 through which drive element 3 projects to be smaller, thereby further preventing deterioration of its sealing effect and facilitating assembly.

Figure 9:
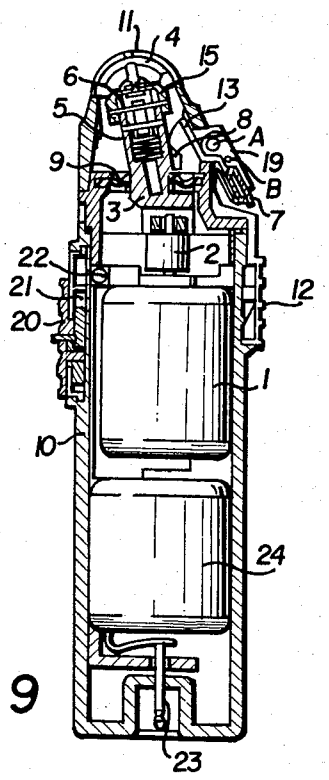
FIG. 9 is a side view, in cross-section, of an eighth embodiment of the electric shaver of the claimed invention.
Figure 10:
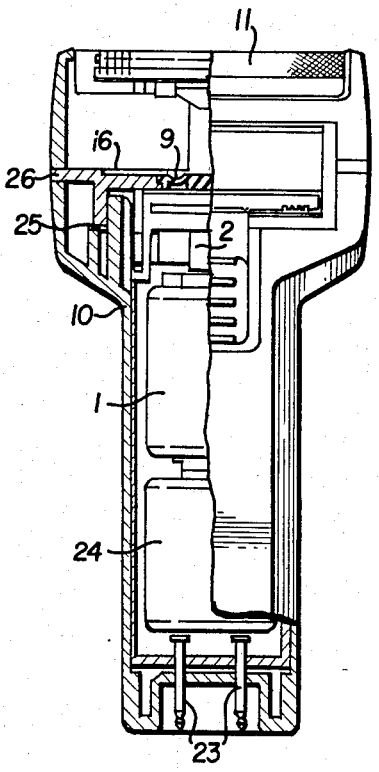
FIG. 10 is a front view, partly in cross-section, of the electric shaver of FIG. 9.
Figure 11:
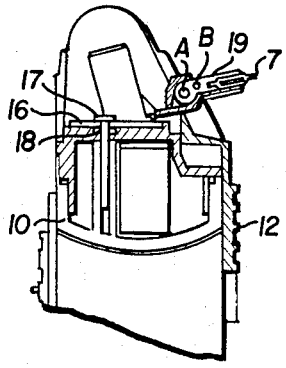
FIG. 11 is a partial side view, in cross-section, of the electric shaver of FIG. 9, showing the trimmer thereof in operating position.
Figure 12:
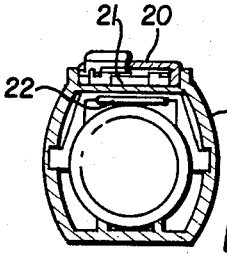
FIG. 12 is an end view, in cross-section, of the electric shaver of FIG. 9, showing an alternative trimmer handle assembly therefor.

Referring to FIG. 9, a metallic retainer plate 16 is provided on the mounting piece 26, as shown in FIG. 10, and has a central opening through which drive element 3 may project. However, the dimensions of the retainer plate opening are such that the retainer plate extends over the inner bead of sealing plate 9 to retain it on mounting piece 26. Screw 17 may be used to fix the retainer plate 16 through O-ring 18 to casing 10 as shown in FIG. 11, thereby further improving the sealing effect. The pivot A of rotation of trimmer 7 is positioned outside and above casing 10 and externally of sealing plate 9. Trimmer 7 is mounted onto a trimmer mounting base and is rotatable about pivot A thereof. A fulcrum B is provided on trimmer blade base 19 of trimmer 7. Fulcrum B is connected to trimmer handle 12 which is slidably mounted on casing 10 so that when trimmer handle 12 is pushed upwardly it raises fulcrum B, thereby rotating trimmer 7 upward and outward as shown in FIG. 11. The interior of casing 10 is separated and sealed from trimmer 7 by sealing plate 9. In the embodiment in FIGS. 9 and 11, the trimmer handle 12 is separate from electrical switch handle 20 which actuates motor 1, but these may alternatively be combined in one assembly. In the latter instance, it is preferable that a magnet 21, as shown in FIG. 12, be provided within switch handle 20 which is incorporated with trimmer handle 12. Magnet 21 acts to actuate a reed switch 22 within casing 10 for motor 1. Trimmer handle 12 is so designed and mounted that when it is pushed up to a first position, reed switch 22 is activated by magnet 21 of switch handle 20 incorporated in trimmer handle 12, but trimmer handle does not engage fulcrum B to project trimmer 7. When the handle 12 is pushed further upward to a second position, reed switch 22 remains on, but trimmer handle engages fulcrum B to project trimmer 7. This may be accomplished by connecting trimmer handle 12 and fulcrum B through a lost-motion slot of appropriate dimensions on trimmer handle 12 or at fulcrum B to delay engagement of these elements until trimmer handle 12 reaches its second position. Switch handle 20 is separate from reed switch 22 and casing 10 is interposed therebetween so that when magnet 21 in switch handle 20 is moved to actuate reed switch 22 and operate motor 1, water-tightness is maintained. Power supply terminals 23 connect to a battery 24 which is connected to motor 1. The power supply terminals 23 are primer-coated on the surfaces with an adhesive or water glass series adhesive of good adhesion to the casing 10, and thereafter the terminals 23 and housing 10 are simultaneously molded to complete the water-sealing. An O-ring 25 for water-sealing is provided between the casing 10 and the support piece 26.

What is claimed is:

1. An electric shaver having at its upper end an outer blade frame carrying an outer blade said shaver comprising:

a motor housing having therein a motor;

an inner blade frame having thereon a plurality of spaced inner blades positioned to be driven in slidable movement relative to said outer blade;

a drive element operatively connected to the motor to be driven thereby to move and having at its upper end portion a drive rod portion which is coupled to said inner blade frame;

a support interposed between the housing and the outer blade frame, said support being in the form of a sleeve having at its upper end an open border frame and which defines thereabove with the outer blade frame an inner blade chamber for receiving therein the inner blade frame and the drive rod portion of the drive element and which further defines adrive unit chamber in the housing for receiving the motor;

a sealing plate of resilient material having a central opening through which said drive rod portion extends upwardly into said inner blade chamber, said sealing plate being seated within said open border frame so that its outer circumferential edge is fixed thereto to establish a water-tight seal between said inner blade chamber and said drive unit chamber; and sealing means disposed at the juncture of the support and the housing to establish a watertight seal therebetween.

2. An electric shaver as set forth in claim 1, wherein said drive rod portion is provided with a trimmer drive lever for driving a trimmer mounted on the outer blade frame.

3. An electric shaver as set forth in claim 2, wherein the central opening of said dustproof plate is disposed at the juncture portion of the drive rod portion and the trimmer drive lever.

4. An electric shaver as set forth in claim 2, wherein said trimmer drive lever is integrally formed with said dustproof plate.

5. An electric shaver as set forth in claim 2, wherein said trimmer drive lever is detachably connected to the drive rod portion.

6. An electric shaver as set forth in claim 1, wherein said inner blade frame is provided with a trimmer drive lever for driving a trimmer mounted on the outer blade frame.

7. An electric shaver as set forth in claim 1 in which said sealing plate has an inner bead portion around said central opening, said inner bead portion engaging and sealing against said drive element.

8. The electric shaver of claim 1 in which the sealing means is an O ring.

* * * * *